US006863202B2

(12) United States Patent
Ammerman

(10) Patent No.: US 6,863,202 B2
(45) Date of Patent: Mar. 8, 2005

(54) SHOULDER CARRIER WITH INFLATABLE LUMBAR SUPPORT

(75) Inventor: Jill Greene Ammerman, Beverly Farms, MA (US)

(73) Assignee: Airpacks, Inc., Beverly, MA (US)

( * ) Notice: Subject to any disclaimer, the term of this patent is extended or adjusted under 35 U.S.C. 154(b) by 0 days.

(21) Appl. No.: 10/260,731

(22) Filed: Sep. 30, 2002

(65) Prior Publication Data

US 2003/0141333 A1 Jul. 31, 2003

Related U.S. Application Data

(63) Continuation-in-part of application No. 09/562,361, filed on May 1, 2000, now Pat. No. 6,471,105, which is a continuation-in-part of application No. 09/434,633, filed on Nov. 5, 1999, now abandoned, which is a continuation of application No. 09/078,462, filed on May 14, 1998, now abandoned.

(51) Int. Cl.[7] ..... A45E 3/02

(52) U.S. Cl. ..... 224/607; 224/264; 224/625; 224/643; 224/644; 150/110

(58) Field of Search ..... 224/600, 607, 224/608, 610, 612, 643, 644, 264; 150/110

(56) References Cited

U.S. PATENT DOCUMENTS

| | | | |
|---|---|---|---|
| 900,610 | A | 10/1908 | Stow |
| 1,444,157 | A | 2/1923 | Lee |
| 2,210,351 | A | 8/1940 | Westendorf |
| 2,604,917 | A | 7/1952 | Reilly |
| 2,608,326 | A | 8/1952 | Spector |
| 2,672,963 | A | 3/1954 | Epton |
| 2,676,737 | A | 4/1954 | Zirbel |
| 3,071,133 | A | 1/1963 | Eisen |
| 3,462,069 | A | 8/1969 | Suominen |
| 3,482,761 | A | 12/1969 | Suominen et al. |
| 3,500,973 | A | 3/1970 | Bush |
| 3,521,623 | A | 7/1970 | Nichols et al. |
| 3,665,551 | A | 5/1972 | Ender |
| 3,667,457 | A | 6/1972 | Zumaglini |
| 3,679,108 | A | 7/1972 | Ingram |
| 3,753,824 | A | 8/1973 | Bosse |
| 3,799,413 | A | 3/1974 | McBain |
| 3,818,962 | A | 6/1974 | Muller-Scherak |
| 3,883,053 | A | 5/1975 | Prichard et al. |
| 3,902,640 | A | 9/1975 | Geiben |
| 3,957,282 | A | 5/1976 | Finnigan |
| 3,994,372 | A | 11/1976 | Geller et al. |
| 4,135,503 | A | 1/1979 | Romano |
| 4,176,772 | A | 12/1979 | Danon |
| 4,384,602 | A | 5/1983 | Ores |
| 4,500,019 | A | 2/1985 | Curley, Jr. |
| 4,550,869 | A | 11/1985 | Johnson |
| 4,559,933 | A | 12/1985 | Batard et al. |

(List continued on next page.)

FOREIGN PATENT DOCUMENTS

| | | |
|---|---|---|
| GB | 219874 | 12/1923 |
| WO | WO 94/28756 | 12/1994 |

*Primary Examiner*—Stephen K. Cronin
(74) *Attorney, Agent, or Firm*—Wolf, Greenfield & Sacks, P.C.

(57) ABSTRACT

A shoulder carrier having at least one shoulder strap connected to a container. A lumbar support attached to the container bears on a wearer's hip or lumbar spine to transfer weight of the shoulder carrier to the hip or lumbar spine and away from the wearer's shoulder. The shoulder strap can include a shoulder pad, and both the shoulder pad and lumbar support can be or include a fluid-filled bladder. The shoulder pad can be slidably attached to the shoulder strap to prevent abrasion of the wearer's shoulder. At least one end of the shoulder strap can be attached to the container by passing the strap through a guide attached to the container and attaching the shoulder strap end to the container at a position below the guide.

17 Claims, 7 Drawing Sheets

U.S. PATENT DOCUMENTS 4,573,202 A 2/1986 Lee
4,681,113 A 7/1987 Coplans
4,682,587 A 7/1987 Curlee
4,739,913 A 4/1988 Moore
4,744,398 A 5/1988 Clark
D298,386 S 11/1988 Hirahara
4,789,202 A 12/1988 Alter
4,826,060 A 5/1989 Hollingsworth
D302,748 S 8/1989 Dubeck et al.
4,852,778 A 8/1989 Beiser et al.
4,887,318 A 12/1989 Weinreb
4,948,023 A 8/1990 Tripp
4,978,044 A 12/1990 Silver
4,986,805 A 1/1991 Laramore
4,989,656 A 2/1991 Derfler
4,993,409 A 2/1991 Grim
5,012,964 A 5/1991 Falletta et al.
5,016,620 A 5/1991 Matthews
5,062,414 A 11/1991 Grim
5,072,727 A 12/1991 Aronne
5,195,948 A 3/1993 Hill et al.
5,203,482 A 4/1993 Puff
5,205,814 A 4/1993 Lundrigan et al.
5,228,609 A 7/1993 Gregory
5,249,890 A 10/1993 Bergstrom
5,297,304 A 3/1994 O'Sullivan
5,348,155 A 9/1994 Ishiwa
5,349,706 A 9/1994 Keer
5,361,957 A 11/1994 Weintraub
5,378,224 A 1/1995 Billotti
5,396,906 A 3/1995 Harrold
D357,583 S 4/1995 Bauman
5,415,332 A 5/1995 Kliot
5,419,473 A 5/1995 Lamar
5,429,288 A 7/1995 Sattler
5,435,647 A 7/1995 Oliver
5,437,615 A 8/1995 Pekar et al.
5,507,422 A 4/1996 Shields
5,526,969 A 6/1996 Greenberger
5,529,229 A 6/1996 Fier
5,547,461 A 8/1996 Levis
5,551,614 A 9/1996 Ham
5,566,871 A 10/1996 Weintraub
5,626,507 A * 5/1997 Gillen ..... 450/86
5,632,429 A 5/1997 Cantwell
5,884,737 A 3/1999 Cabo
5,894,977 A 4/1999 Krueger et al.
6,003,744 A 12/1999 Culjak
6,109,495 A 8/2000 Hernandez
6,164,509 A 12/2000 Gausling et al.
6,257,472 B1 7/2001 Freedman
6,331,170 B1 * 12/2001 Ordway ..... 602/19
6,364,186 B1 * 4/2002 Gilmour et al. ..... 224/637
6,467,661 B1 * 10/2002 Mistretta et al. ..... 224/264
6,626,341 B2 * 9/2003 Mitchell ..... 224/576
6,644,522 B2 * 11/2003 Preiss ..... 224/264
6,678,895 B1 * 1/2004 Grilliot et al. ..... 2/81
2002/0134805 A1 * 9/2002 Preiss ..... 224/264

* cited by examiner

SHOULDER CARRIER WITH INFLATABLE LUMBAR SUPPORT

RELATED APPLICATIONS

This application is a continuation-in-part application of U.S. patent application Ser. No. 09/562,361 filed May 1, 2000 now U.S. Pat. No. 6,471,105, which is a continuation-in-part application of U.S. patent application Ser. No. 09/434,633, filed Nov. 5, 1999 now ABN, which is a continuation application of U.S. patent application Ser. No. 09/078,462, filed May 14, 1998 now ABN. Application Ser. Nos. 09/562,361, 09/434,633 and 09/078,462 are hereby incorporated by reference in their entirety.

FIELD OF THE INVENTION

The invention relates to shoulder carriers having a lumbar support.

BACKGROUND OF THE INVENTION

Shoulder carriers, such as backpacks, golf bags, garment bags, mail-carrier bags, etc., are widely used and are available in a variety of different special-use and general purpose configurations. For example, backpacks are available for carrying small children, for carrying relatively large amounts of weight for extended hiking or cold-weather travel, for carrying schoolbooks, etc. Several such examples are shown in U.S. Pat. Nos. 3,679,108; 3,902,640; 4,384,602; 5,526,969; 5,529,229; and 5,547,461.

Shoulder carriers typically require most of the weight of the carrier to be borne on the shoulders of the wearer. This weight distribution causes the wearer to not stand with proper posture (i.e., straight), and thus can lead to back injuries, muscles strains or other problems. In addition, overloading of the wearer's shoulders can itself cause injuries, such as strain of the trapezius muscle, pinching of nerves near the spine, etc.

Some shoulder carriers, such as technical backpacks used for multi-day hiking trips disclosed in U.S. Pat. No. 5,547,461, use a hip belt to transfer weight of the carrier to the hips or lumbar region of a wearer's back, thereby decreasing the amount of weight on the wearer's shoulders. However, such solutions require a hip belt that is tightened around the wearer's hips for the weight transfer to be effective. Without the hip belt, no weight transfer to the hips or lumbar region would occur.

SUMMARY OF THE INVENTION

The invention provides a shoulder carrier having at least one shoulder strap and a lumbar support connected to a container. In one aspect of the invention, weight of items in the container, as well as of the carrier itself, can be borne on a wearer's shoulders as well as on the hip or lumbar region of the wearer's back without using a hip belt. Weight of the carrier is transferred to the wearer's hip or lumbar region, at least in part, by the lumbar support. Weight transfer is achieved by the lumbar support resting on the wearer's hip or lumbar region using the unique features of the invention, thus transferring weight away from the shoulder and making the carrier seem lighter to the wearer. Weight transfer may be enhanced by the way in which a shoulder strap is attached to the carrier container. As used herein, the term shoulder carrier refers to any device for carrying weight that includes at least one shoulder strap to transfer weight of a carrier to a shoulder of the wearer. Examples of a shoulder carrier are a garment bag, mail-carrier bag, golf bag, backpack, briefcase, etc. The term lumbar support refers to a resilient portion of the shoulder carrier that can be used to contact and transfer weight of the carrier to a wearer's lumbar region of the back or hips. Thus, the term lumbar support does not preclude an arrangement in which weight of the shoulder carrier is transferred only to a wearer's hip, and not the lumbar region of the wearer's back.

In one aspect of the invention, the shoulder carrier is a single strap carrying bag with a lumbar support. Thus, unlike conventional bags having only a single shoulder strap, the single strap shoulder carrier according to this aspect of the invention allows weight of the bag to be transferred to a wearer's hip or lumbar region of the back in addition to the wearer's shoulder.

In one aspect of the invention, a shoulder carrier includes a container having a top, a bottom and a rear into which items to be carried can be placed. Only a single shoulder strap has a top end attached near the top of the container and a bottom end attached near the bottom of the container. The single shoulder strap extends along a midline of the container. A shoulder pad is mounted to the single shoulder strap, and a lumbar support is attached to the rear of the container that bears on a wearer's hip or lumbar region to transfer weight in the container to the hip or lumbar region. The lumbar support has a fluid-filled bladder, and a portion that projects from the rear of the container and extends across the rear of the container.

In another aspect of the invention, a shoulder carrier includes a container having a top, a bottom and a rear into which items to be carried can be placed. Only a single shoulder strap having opposite ends is attached to the container. A shoulder pad is mounted to the single shoulder strap and has a fluid-filled bladder. A lumbar support is attached to the rear of the container that bears on a wearer's hip or lumbar region to transfer weight in the container to the hip or lumbar region, the lumbar support having a fluid-filled bladder, and having a portion that projects from the rear of the container and extends across the bottom of the container.

In one aspect of the invention, the lumbar support includes an inflatable bladder.

In one aspect of the invention, the shoulder carrier can include a waist strap to help maintain proper positioning of the carrier on the wearer's body. The waist strap need not be intended to help transfer weight to a wearer's hip, but rather serve only to keep the lumbar support in contact with the wearer.

In one aspect of the invention, the shoulder strap passes through a guide attached to the container near a top of the lumbar support, extends below the lumbar support adjacent the container, and is attached near a bottom of the container. The guide can be positioned on a back portion of the container nearest the wearer, or be positioned on a side portion of the container. Similarly, the strap can be attached to the container on a back portion of the container nearest the wearer or along a side portion of the container. The portion of the shoulder strap that extends between the guide and where the strap is attached to the container can extend over the lumbar support or along a side of the lumbar support. The portion of the strap between the guide and where the strap is attached to the container may not be attached to the container or the lumbar support. Attaching a shoulder strap according to this aspect of the invention may enhance weight transfer to the wearer's hip or lumbar region of the back.

In one aspect of the invention, the shoulder strap includes a pad to more comfortably and resiliently distribute force of the shoulder strap to the wearer's shoulder. The pad can include an inflatable bladder and may have several compartments having a roughly rectangular pillow shape, e.g., to facilitate bending of the strap to conform to a wearer's shoulder without kinking.

In one aspect of the invention, a shoulder strap pad is slidably attached to the shoulder strap.

In one aspect of the invention, the shoulder carrier includes a shoulder pad that is slidably attached to the shoulder strap and has a fluid-filled bladder. The lumbar support also includes a fluid-filled bladder. The shoulder strap passes through a guide attached to the container near an upper portion of the lumbar support and extends down to a lower portion of the container where the strap is attached. A waist belt can also be included to keep the shoulder carrier in a desired position relative to the wearer, but not necessarily for transferring weight of the carrier to the wearer's hip or back.

The invention also provides a method for positioning a shoulder carrier on a wearer. A shoulder carrier having at least one strap, and no hip belt that is intended to to carry weight on the hips of a wearer, is positioned so that a lumbar support of the carrier contacts a lumbar area or hip area of the wearer. Other portions of the carrier, except for the at least one shoulder strap, need not contact any portion of the wearer. By properly positioning the shoulder carrier, weight of the carrier is transferred to the lumbar area or hip without using a hip belt.

In one aspect of the invention, a length of the at least one shoulder strap is adjusted to properly position the lumbar support on the wearer.

In one aspect of the invention, an air pressure in the lumbar support is adjusted to provide varying weight transfer and comfort characteristics.

In one aspect of the invention, a waist strap is attached around the wearer to keep the shoulder carrier in a desired position on the wearer.

Various other features and advantages of the invention will be apparent and/or obvious from the following detailed description, which should be read in conjunction with the accompanying drawings and claims.

BRIEF DESCRIPTION OF THE DRAWINGS

The invention is described with reference to the following drawings, in which like reference numerals refer to like elements, and wherein.

DETAILED DESCRIPTION

Aspects of the invention are described below with reference to various embodiments, such as: a general purpose single strap carrier, a garment bag and a backpack. However, it should be understood that the invention is not limited to these three embodiments. For example, the invention could be used with golf bags, mail-carrier bags, baby carriers, etc. Therefore, the term shoulder carrier refers to any apparatus used to carry weight in which at least some of the weight is supported by a wearer's shoulder.

Figure 1:
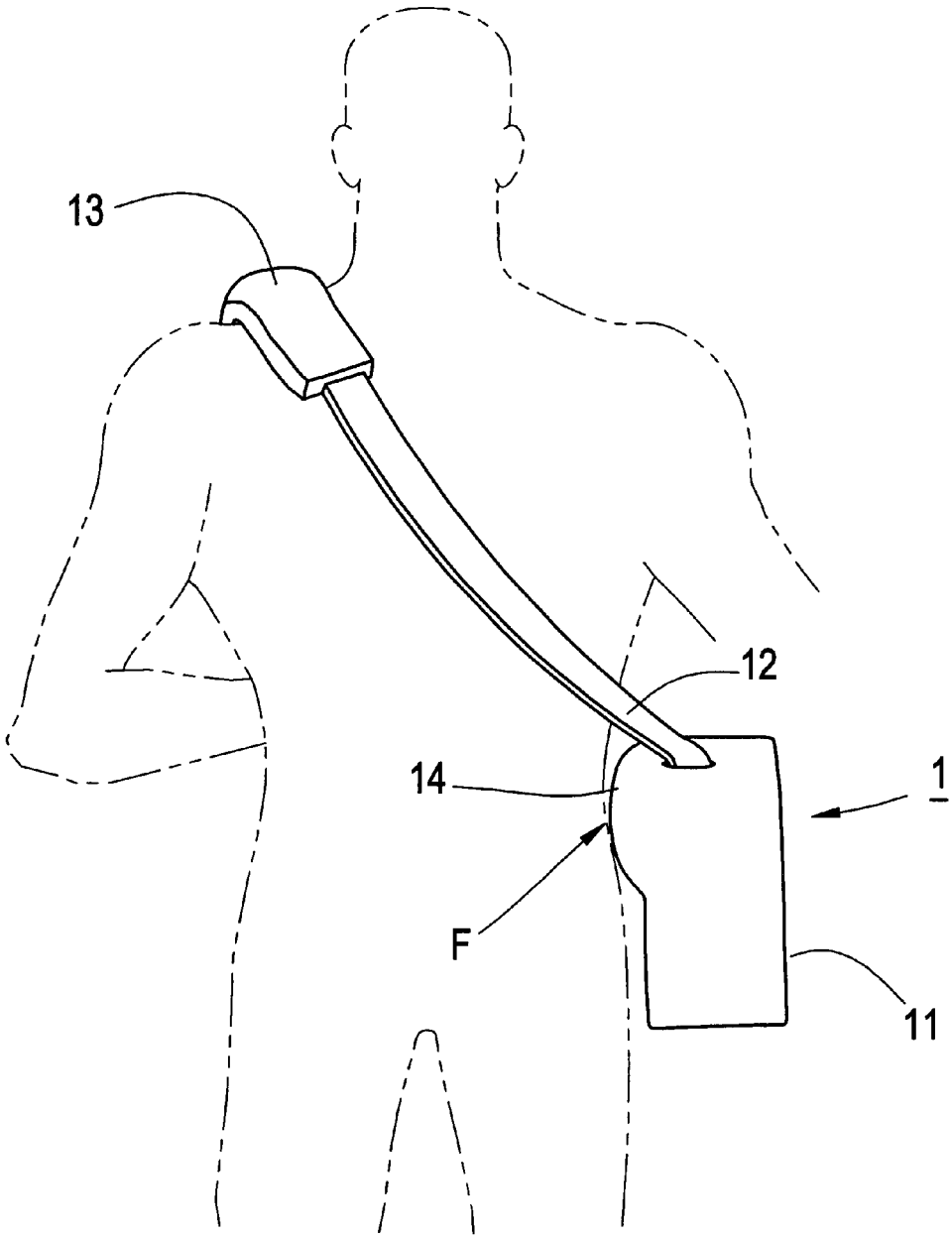
FIG. 1 shows a shoulder carrier supported on a hip of a wearer.

FIG. 1 shows a shoulder carrier 1 as worn on a hip of a wearer. In this example, the shoulder carrier 1 includes a container 11, which can be used for carrying various items such as books, clothes, tools, etc. The container 11 can be made of a flexible material, such as a nylon or other polymer fabric and/or include stiffening elements to help define the shape of the container 11. For example, the container 11 could include a molded plastic insert that is placed inside of a flexible fabric bag to give the container 11 a more defined shape. The container 11 also could have selected portions that are made more rigid than other portions of the container 11. For example, a bottom portion of the container 11 could be made more stiff than other portions of the container 11 to give the container 11 a more defined bottom section. Portions of the container 11 can be made more stiff by attaching stiffening elements, such as plastic rods, resilient foam pads, or other items to a flexible fabric shell. Of course, the container 11 could be made entirely of a flexible material, such as a conventional duffel bag, or the container 11 could be made entirely of a rigid material, such as a molded plastic suitcase. In short, the container 11 can be formed in any of the various well-known ways for producing carrying bags or containers.

The shoulder carrier 1 also includes a shoulder strap 12 that is attached to the container 11 and transfers some of the weight in the container 11 to a shoulder of the wearer. The strap 12 is preferably made of a flexible material, such as leather or a polymer fabric and has a width of one inch or more to help distribute weight more evenly on the wearer's shoulder. However, the shoulder strap 12 could be made of any desired material and in any width or cross section provided that the shoulder strap 12 can provide desired weight supporting characteristics. The shoulder strap 12 can be made to resist stretching or other lengthening of the shoulder strap 12 in response to static or dynamic loads on the strap 12. Alternately, the strap 12 could include elements or be made of a material that stretches when the strap 12 is subjected to static or dynamic loads. Stretching of the strap 12 or elements within the strap 12 could reduce dynamic loads on a wearer's shoulder such as when the wearer runs while wearing the shoulder carrier 1. The shoulder strap 12 can also include a length adjusting element so that the length of the strap 12 can be adjusted as is well-known in the art. Although the shoulder strap 12 is shown in FIG. 1 draped over the wearer's far shoulder relative to the shoulder carrier 1, the shoulder strap 12 could be worn on the shoulder nearest the shoulder carrier 1.

A pad 13 is also preferably included and positioned between the strap 12 and the wearer's shoulder. The pad 13 can be made of any type of material to distribute the force of the strap 12 on the wearer's shoulder. For example, the pad 13 could include a resilient foam element or a fluid-filled bladder. For example, the fluid-filled bladder could be filled with air and/or a gel, and the bladder may optionally be compartmented. The pad 13 may also include other optional features. For example, the pad 13 may be attached to the shoulder strap so that the pad 13 slides freely along the strap 12. Thus, once the pad 13 is in place on a wearer's shoulder, the pad 13 can stay in place when the container 11 is moved, e.g., from a wearer's hip to the wearer's back. This feature can reduce or eliminate abrasion of the strap 12 on the wearer's shoulder as the container 11 moves. In addition, the pad 13 could function to reduce dynamic loads on the wearer's shoulder. For example, a fluid-filled bladder could dynamically compress and expand as dynamic loads are placed on the strap 12. This action of the bladder can absorb some of the dynamic energy like a shock absorber and increase the wearer's comfort.

The shoulder carrier 1 also includes a lumbar support 14 positioned between the wearer's hip and the container 11 as shown in FIG. 1. The lumbar support 14 may contribute enormously to the comfort of the wearer in a variety of ways. For example, the support 14 may transfer some of the weight of the shoulder carrier 1 to the hip or lumbar region of the wearer's back. Therefore, not all of the weight of the carrier 1 is borne on the shoulder of the wearer. The support 14 transfers weight of the carrier 1 by contacting, or resting on, a portion of the wearer's hip or back that curves outward. Therefore, the hip or back of the wearer exerts a force F on the support 14 that is directed somewhat upward at an angle from the horizontal, as shown in FIG. 1. A vertical component of this force F counteracts the force of gravity on the container 11 and represents an amount of weight of the carrier 1 that is carried by the hip or back of the wearer and not by the shoulder.

Figure 16:
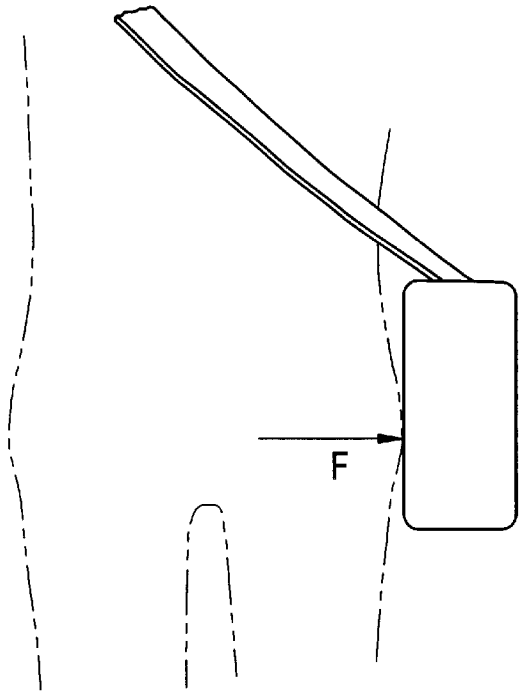
FIG. 16 PRIOR ART
FIG. 16 shows a conventional shoulder bag.

Conventional shoulder bags, such as that shown in FIG. 16, do not include a lumbar support 14, and thus do not allow the wearer's hip or back to support any of the weight of the bag. In the example shown in FIG. 16, the wearer's hip exerts a force F on the bag in a generally horizontal direction. Thus, since the force F is not directed upward at all, none of the weight of the bag is supported by the wearer's hip.

The lumbar support 14 may provide additional advantages. For example, the support 14 may separate the container 11 from the wearer so that the container 11 can be held somewhat away from the wearer. When the wearer moves, since the container 11 is positioned away from the wearer, the container 11 can be prevented from contacting the wearer, such as the wearer's lower hip or leg area. The lumbar support 14 may also prevent movement of the container 11 relative to the wearer as the wearer moves because the support 14 can deform to the contour of the wearer's hip, enabling the lumbar support 14 to contact a broad area of the hip. This broad area of contact can enhance the amount of weight supported by the wearer's hip as well prevent sway or other movement of the container 11 as the wearer moves.

The lumbar support 14 can be made of or include various materials. For example, the lumbar support 14 can be made of or include a resilient foam or a fluid-filled bladder. Preferably, the support 14 includes a fluid-filled bladder that is inflated with air. Since the support 14 can be inflated with air, the support 14 can be filled with varying amounts of air depending on the application. One or more valves can be provided to adjust the amount of air in the bladder. For example, women tend to have a broader hip area than men and therefore require somewhat higher inflation of the bladder.

Figure 2:
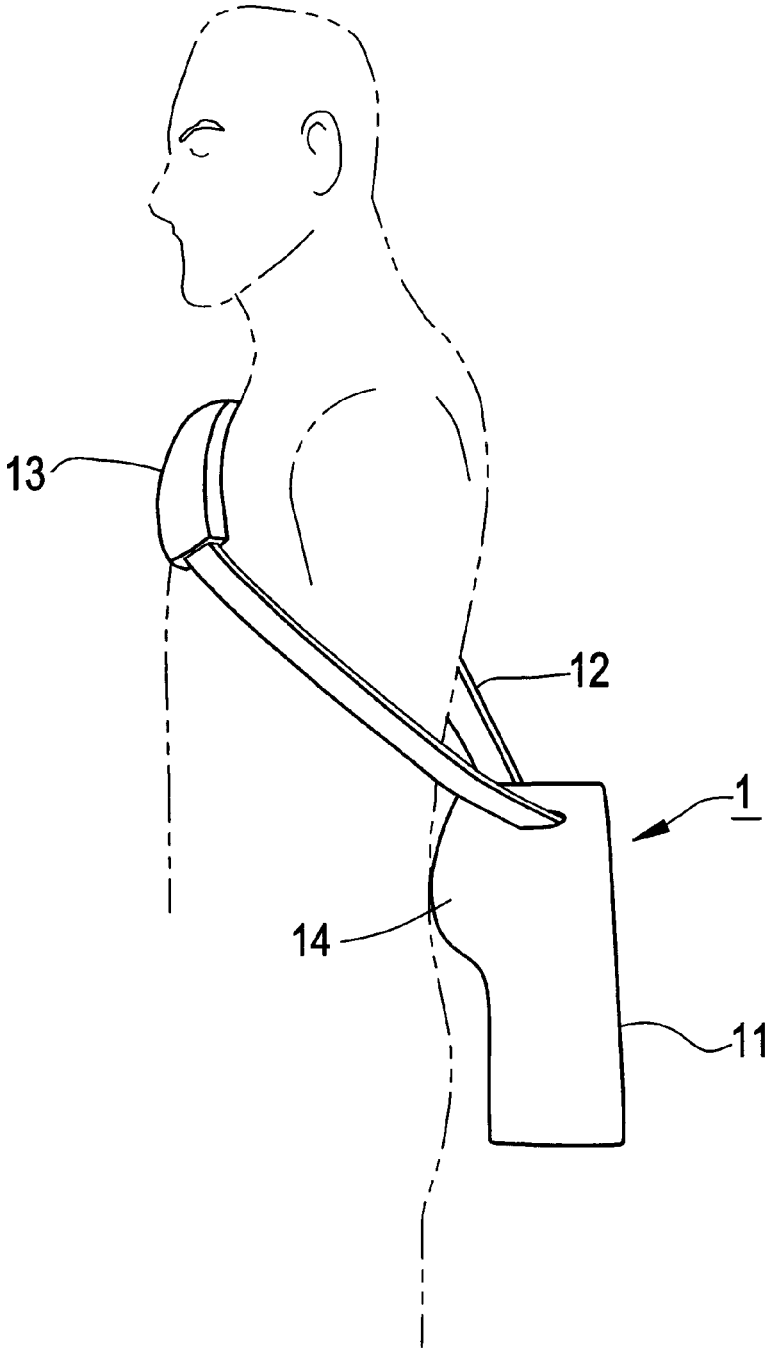
FIG. 2 shows a shoulder carrier supported by a lumbar region of a wearer's back.

FIG. 2 shows a shoulder carrier 1 positioned on the lumbar region of the back of a wearer. Similar to the configuration shown in FIG. 1, the lumbar support 14 is positioned near where the wearer's back curves outward. Thus, a portion of the shoulder carrier 1 weight rests on, i.e., is supported by, the lumbar area of the wearer.

Figure 3:
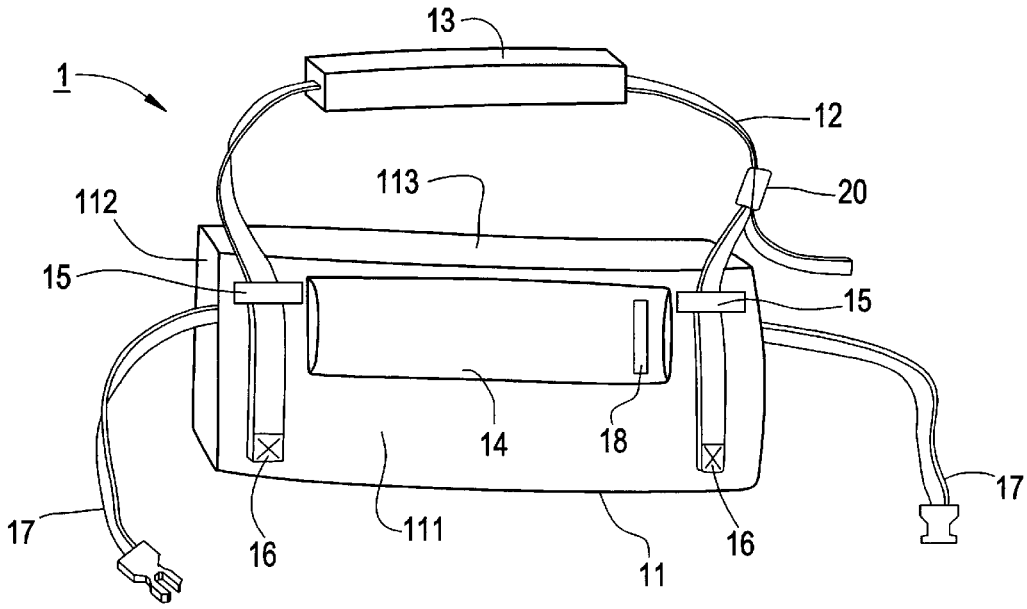
FIG. 3 is a rear view of a shoulder carrier having a single strap and waist belt.

FIG. 3 is a rear view of an exemplary shoulder carrier 1 having a single shoulder strap 12. In this example, the container 11 has a box-like shape and is formed from a woven nylon fabric. Of course, other materials can be used to form the container 11 as is well known in the art. The container 11 has a top portion 113 that can be covered by a flap (not shown). The flap can be attached to the container 11 along a junction between a back panel 111 of the container and the top portion 13. By lifting the flap, the top portion 113 can be opened to allow items to be placed inside of the container 11. It should be understood that this is only one example of how access to the interior of the container 11 can be provided. For example, a zipper opening could be provided in the top portion 113 and/or the side portion 112 of the container 11. Other container 11 configurations will occur to those skilled in the art.

The shoulder strap 12 includes an optional adjuster for adjusting the length of the strap 12. Such adjusters 20 are well known in the art and can include friction-type adjusters, buckles, hook-and-loop connectors (VELCRO™), etc. The manner in which the shoulder strap 12 is attached to the container 11 as shown in FIG. 3 has been found to provide improved weight transfer to the wearer's lumbar back or hip. End portions of the shoulder strap 12 pass through guides 15 attached to the back portion 111, or the side portions 112, of the container 11 and attach near a bottom of the container 11 at attachment points 16. The guides 15 can be any type of device that allows the shoulder strap 12 to pass freely through the guide 15. For example, the guides 15 can be strips of webbing that are sewn at opposite ends to the back portion 111, or sides 112, of the container 11. Central portions of the webbing are not attached to the back or side portions to form a guide hole through which the strap 12 passes. The guides 15 could be formed in other ways, such as by attaching a plastic or metal ring to the container and passing the strap 12 through the ring. This configuration for attaching the strap 12 to the container 11 has been found to stabilize the shoulder carrier 1 when a wearer moves, i.e., the container 11 tends to move less relative to the wearer than other strap attachment configurations. However, the strap 12 ends can be attached to the container 11 in other ways, including by positioning the attachment points 16 on the back portion 111 near a top of the container 11, e.g., at a position where the guides 15 are shown in FIG. 3, by attaching the strap 12 ends near a top of the side portions 112, or in other ways. When the preferred strap attachment configuration shown in FIG. 3 is used, the bottom of the container 11 tends to be drawn upward toward the guides 15 when the shoulder carrier 1 is worn. This action can be desirable by causing the weight of the container 11 to be concentrated near the lumbar support 14, and preventing portions other than the lumbar support 14 from contacting the wearer's body. However, the back portion 111 or side portions 112 can be stiffened or made rigid to prevent collapse of the back portion 111. As discussed above, the back portion 111 or other portions of the container 11 can be stiffened by attaching stiffening elements to the back portion 111 or by making the back portion 111 or other container 11 portion out of a rigid material.

The shoulder strap 12 can also include a pad 13 as discussed above. The pad 13 can be fixed to the strap 12 or attached so that the pad 13 can slide along the strap 12. The pad 13 can include a fluid-filled bladder, such as an air bladder, a resilient foam member and/or other shock absorbing or force distributing element.

In this embodiment, the lumbar support 14 preferably extends along a top of the back portion 111, but may be positioned at any suitable location, e.g., near the bottom of the container 11. In the example shown in FIG. 3, the lumbar support 14 extends between the guides 15. However, the lumbar support 14 could extend to opposite ends of the container 11 underneath the guides 15. Thus, the guides 15 could be attached to the support 14 or to a portion of the back portion 111 above the lumbar support 14. The lumbar support 14 can include a fluid-filled bladder, such as an air bladder, that is inserted into a pouch formed in or on the back portion 111. That is, a pouch could be sewn into or otherwise formed in the back portion 111 and the air bladder inserted through an access 18 to form the support 14. The access 18 can simply be a hole or other opening in the lumbar support 14 pouch. The access 18 can be made closeable, for example by providing a hook-and-loop closing element, a zipper, a snap closure, etc. Although the lumbar support 14 preferably includes a fluid-filled bladder, the lumbar support 14 can also include a resilient foam or other material.

The lumbar support 14 need not be formed in the back portion 111, but instead could be removably attached to the back portion 111. For example, the lumbar support 14 could be attached to the back portion 111 by hook-and-loop fasteners, by a zipper fastener, etc. Thus, the lumbar support 14 could be removed if desired, e.g., to allow the shoulder carrier 1 to be placed in a relatively small space, such as an airplane overhead bin, or to allow exchanging of differently sized lumbar supports 14.

The shoulder carrier 1 can also include an optional waist belt 17. In contrast to hip belts used in technical backpacks to transfer weight of a carrier to the wearer's hips, the waist belt 17 can be used to hold the container 11 and lumbar support 14 in place relative to the wearer. By keeping the lumbar support 14 in contact with a wearer's hips or lumbar region, weight of the shoulder carrier 1 can be more properly supported. The waist belt 17 can include any type of removable fastener for attaching the waist belt 17 around the wearer and for adjusting the length of the waist belt 17. Thus, the waist belt 17 can include buckles, snap connections, hook-and-loop fasteners, D-ring buckles, etc.

Figure 4:
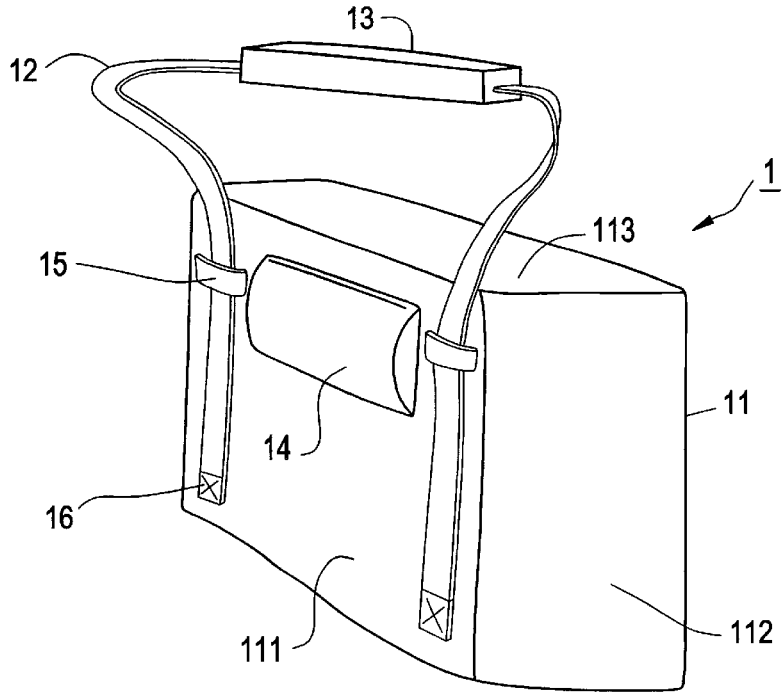
FIG. 4 is an oblique side view of a shoulder carrier having a single shoulder strap.

FIG. 4 shows a perspective side view of the shoulder carrier 1 of FIG. 3. The lumbar support 14 protrudes from the back portion 111 by 1–3 inches or more. As discussed above, the lumbar support 14 preferably includes an air bladder that can be inflated to various levels. Thus, the lumbar support 14 can be adjusted in size and/or shape to adapt to different wearers or other conditions. In addition, the lumbar support 14 can provide structural support for the container 11, specifically the back portion 111.

Figure 5:
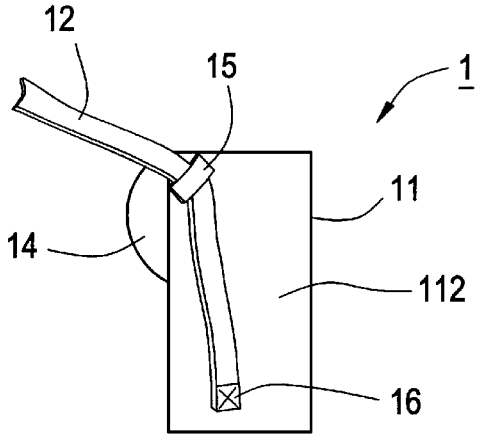
FIG. 5 is a side view of a shoulder carrier having a single strap attached to a side portion of the carrier.

FIG. 5 shows a side view of a shoulder carrier 1 and an optional strap 12 attachment configuration. In this example, the strap 12 passes through a guide 15 attached to a side portion 112 of the container 11. The strap 12 extends down the side portion 112 and is attached at an attachment point 16 near a bottom of the container 11. As in the case where the strap 12 is attached to the back portion 111 of the container 11, the side portion 112 can be made of a rigid material or include stiffening elements, or be made flexible. Of course, other strap attachment configurations can be used with the shoulder carrier 1, such as by simply attaching the strap 12 to the side portions 112 and/or back portion 111 without a guide 15.

Figure 6:
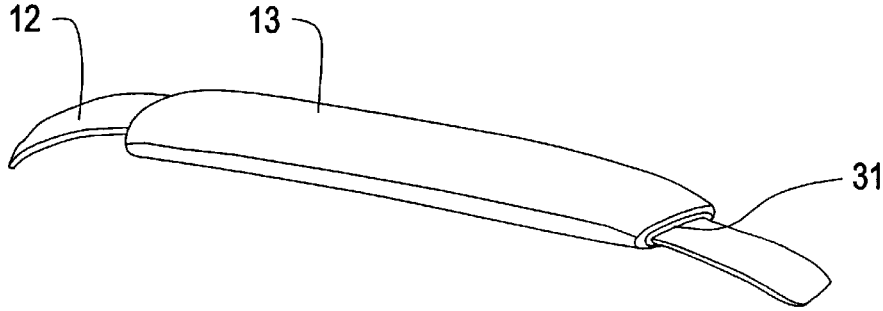
FIG. 6 is a perspective view of a shoulder pad.

FIG. 6 shows a perspective view of a pad 13 for use with the shoulder strap 12. The pad 13 has a channel 31 through which the strap 12 extends. Thus, the pad 13 can freely slide along the strap 12, but be attached to the strap 12.

Figure 7:
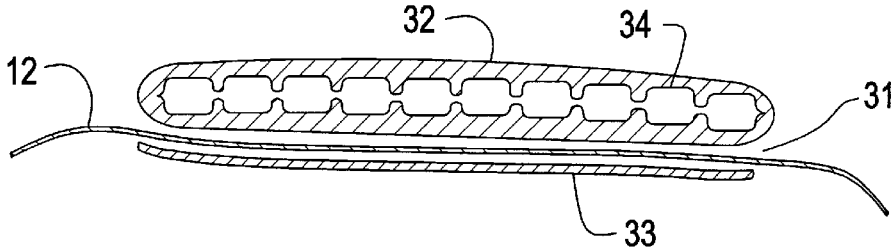
FIG. 7 is a cross-sectional side view of a shoulder pad.

FIG. 7 shows a cross-sectional view of the pad 13 shown in FIG. 6. The strap 12 extends through the channel 31 formed by a lower portion 33 and an upper portion 32 of the pad 13. In this example, the upper and lower portions 32 and 33 are made from a flexible fabric. The lower portion 33 is attached to the upper portion 32, e.g., by sewing, to form the channel 31. A bladder 34 is contained within the upper portion 32 and provides the force distribution features of the pad 13. Thus, the bladder 34 is preferably positioned between the wearer and the strap 12 when the shoulder carrier 1 is carried by the wearer.

Figure 8:
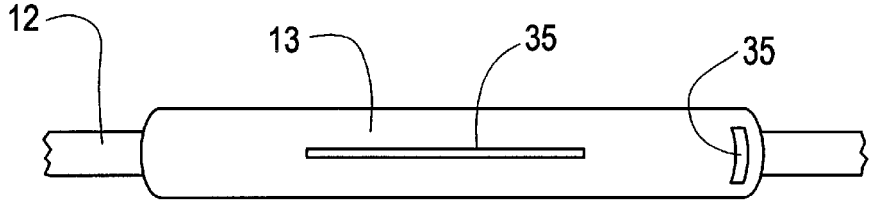
FIG. 8 is a bottom view of a shoulder pad including bladder access openings.

FIG. 8 shows a top view of the pad 13 in the FIG. 6 embodiment. The pad 13 can include one or more accesses 35 to allow the bladder 34 to be removed from the upper portion 32. The accesses 35 can be opened and closed using various fasteners, such as zippers, hook-and-loop fasteners, snap closures, etc. Alternately, the accesses 35 could be eliminated and the bladder 34 not be made removable from the pad 13. In addition, the pad 13 could include only one access 35, if desired. The pad 13 may also include an access 35 so that a bladder valve can be used to adjust the air pressure in the bladder 34 without removing the bladder 34 from the pad 13.

Figure 9:
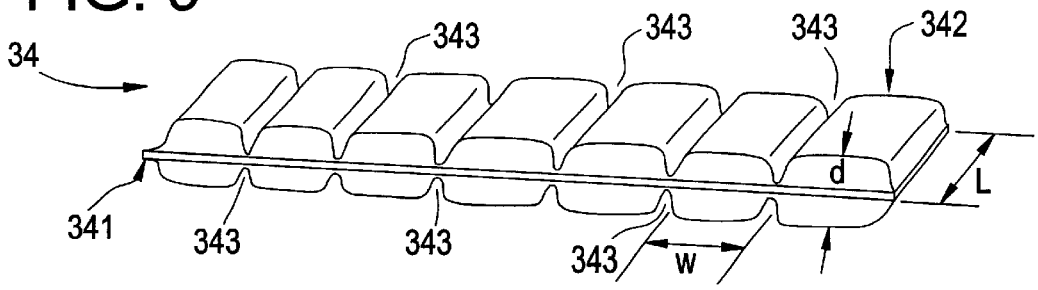
FIG. 9 is a perspective view of a compartment bladder for a shoulder pad.

FIG. 9 shows a perspective view of a bladder 34 to be used in a pad 13. The bladder 34 may be compartmented so that a plurality of approximately rectangular, pillow-shaped compartments communicate with each other. Thus, the bladder 34 can be inflated using a single valve. Preferably, the compartments communicate with each other through passages 343 that are positioned on alternating opposite lateral sides 341 and 342 of the bladder 34. For example, a compartment not positioned at an end of the bladder 34 communicates with a first adjacent compartment, e.g., a compartment immediately to its left, through a passage 343 formed near a first lateral side 341 of the bladder 34, and communicates with a second adjacent compartment, e.g., a compartment immediately to its right, through a passage 343 formed near a second lateral side 342 of the bladder 34. Other than communicating through passages 343, the compartments are isolated from each other. This arrangement can help ensure more uniform inflation of the compartments, especially when a single valve is used. Alternately, the individual compartments can be isolated from each other. This arrangement may be advantageous if, for example, one of the compartments is punctured. In this case, only the one compartment would fail, but other compartments would continue to operate.

The bladder 34 can be made from a thermoplastic material. (e.g., two heat sealed or otherwise welded sheets of plastic material), and can be elastic. Each of the pillow-shaped compartments can have a height d of approximately ¾–2 inches, a length 1 of approximately 3 inches and a width w of approximately 1–2 inches. It should be understood that the bladder 34 shown in FIG. 9 is only one example. The pad 13 can include a bladder 34 having any desired configuration or dimensions.

Figure 10:
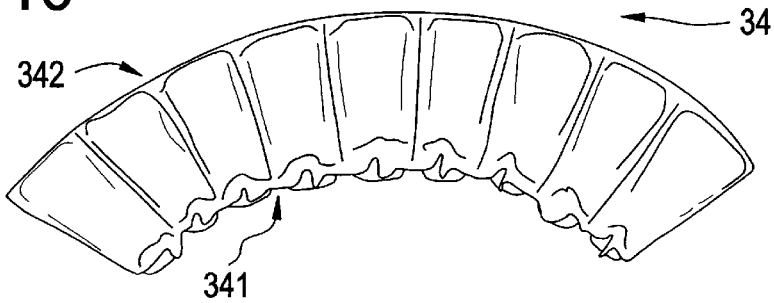
FIG. 10 is a top view of a bladder bent laterally without kinking.

The compartments in the bladder 34 help the pad 13 to conform to a wearer's shoulder without buckling. For example, FIG. 10 shows a top view of the bladder 34 bent laterally to form an arc, e.g., the first lateral side 341 is compressed. The pillow-shaped compartments allow the bladder 34 to bend without kinking, as would occur with conventional foam pads. That is, portions of the compartments near the inside of the bend deform to prevent interference between the compartments and bending of the bladder 34 outside of the plane of the bend. This feature allows the pad 13 to deform and conform to a wearer's shoulder while providing maximum contact with the shoulder.

Figure 11:
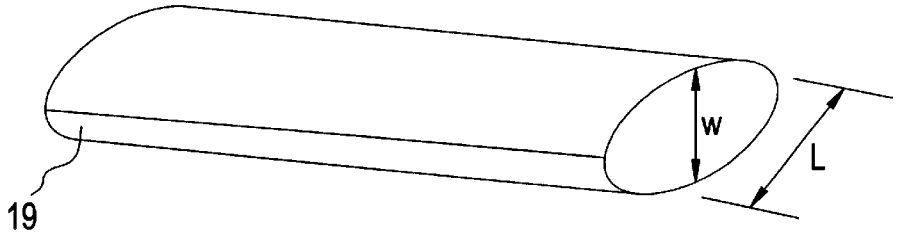
FIG. 11 is a perspective view of a bladder for a lumbar support.

FIG. 11 shows a support bladder 19 that can be used for the lumbar support 14. Similar to the bladder 34, the support bladder 19 can be made of a thermoplastic material and can be filled with a fluid, such as air, a gel, etc. One or more valves can be provided to allow a wearer to adjust the amount of fluid in the bladder 19, and the bladder 19 can optionally be compartmented so that the bladder 19 can still function at some level even if one or more compartments are punctured. In a preferred embodiment, the bladder 19 has a width W of 3–5 inches, and a length L of 5–6 inches. Of course, the dimensions and/or shape of the support bladder 19 can be varied as desired. The bladder 19 can also be formed in any suitable way, e.g., to conform with a wearer's body. The bladder 19 may also include multiple separate pieces that together to form the lumbar support 14. Thus, the lumbar support 14 need not include a single contiguous component that extends over the entire length and/or width of the support 14. Instead, multiple components may together form the lumbar support 14.

Figure 12:
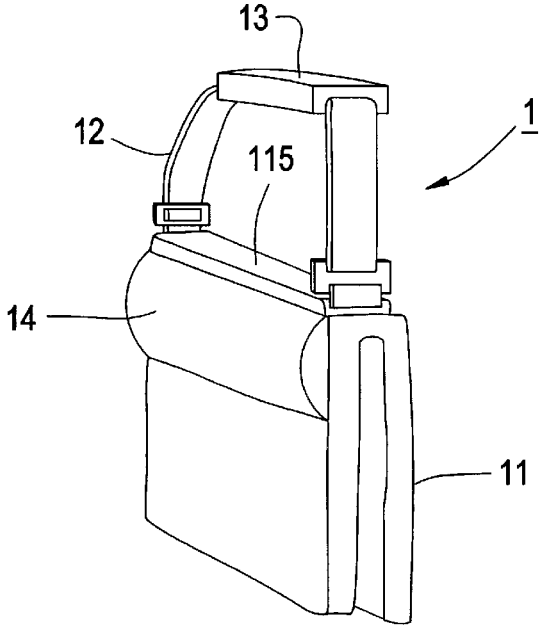
FIG. 12 is a perspective view of a shoulder carrier having a garment bag configuration.

FIG. 12 shows a shoulder carrier 1 in which the container 11 has a garment bag configuration. That is, the container 11 is elongated and folded at a central portion 115 where the shoulder strap 12 is attached. The central portion 115 can include a rigid member to prevent sagging between attachment points of the strap 12 to the container 11. The lumbar support 14 is positioned near the central portion 115 and can provide the weight distribution features described above. The shoulder carrier 1 also has the ends of the shoulder strap 12 attached to opposite ends of the container 11, and not as shown in FIG. 3.

Figure 13:
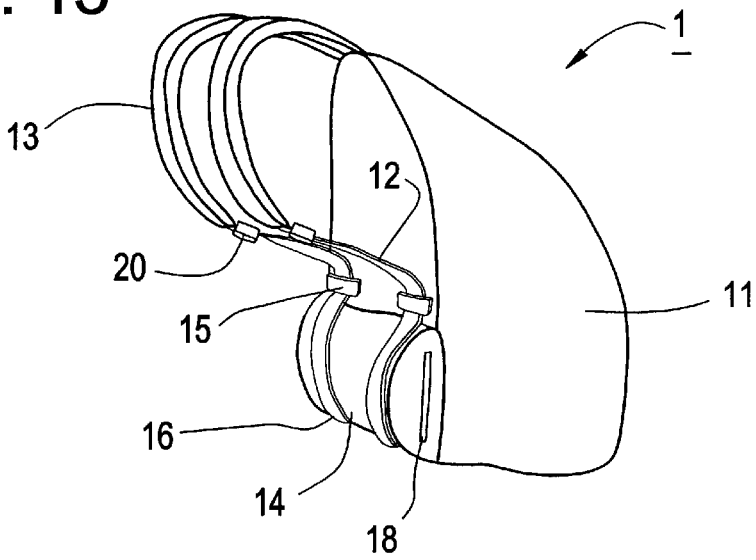
FIG. 13 is a perspective view of a shoulder carrier in a backpack configuration.

FIG. 13 shows another shoulder carrier in the form of a backpack. As with the other examples discussed above, the container 11 can take many different shapes and configurations. For example, the container 11 could have an opening near a top of the container 11 that is covered by a flap. The container 11 may have two or more separate compartments that are accessed through a common opening or by separate openings. The container 11 could also be configured to carry a baby or small child, and may have rigid frame elements to provide structure for the container 11. In short, the container 11 may take any desired shape or configuration such as those used for backpacks in the past or developed in the future.

Figure 15:
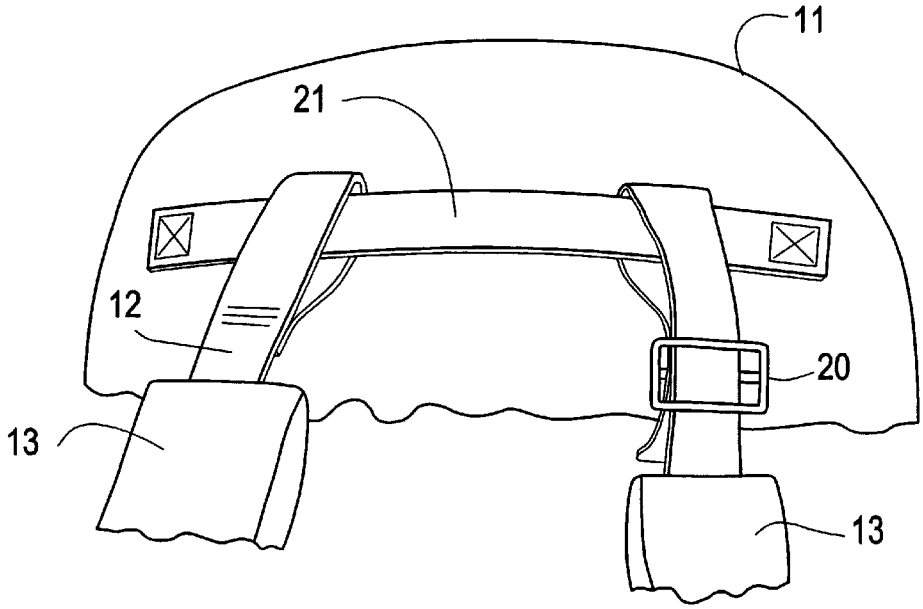
FIG. 15 shows a view of an optional attachment arrangement for the shoulder straps on a backpack.

The backpack in this illustrative embodiment has a pair of shoulder straps 12 that are attached at a top of the container 11. Opposite ends of the straps 12 pass through guides 15 attached to the container 11, over a lumbar support 14 and are fixed to the container 11 at attachment points 16 near a bottom of the lumbar support 14. As in the shoulder carrier 1 shown in FIG. 3, the straps 12 can freely pass through the guides 15 and are otherwise only attached to the container 11 at the attachment points 16. The shoulder straps 12 can also include adjusters 20 for adjusting the length of the straps 12. In the example shown in FIG. 13, the adjusters are positioned between pads 13 and the guides 15. However, the shoulder straps 12 may also have adjusters 20 positioned between the pads 13 and the top of the container 11 where the shoulder straps 12 are attached. In addition, the shoulder straps 12 at the top portion of the container 11 can be directly attached to the container 11 or can be attached to a strap, loop or other intermediate connector that is attached to the container 11. For example, FIG. 15 shows a preferred arrangement for attaching the shoulder straps 12 to the top of the container 11. In this example, the straps 12 are looped around an anchor loop 21 so that the straps 12 can slide along the loop 21. The loop 21 is preferably a piece of flat, flexible webbing that is attached at opposite ends to the container 11, but can take other forms, such as a rigid attachment bar, a flexible member having a circular cross section (e.g., a rope), etc. The straps 12 can be attached to the loop 21 by sewing an end of the strap 12 to another portion of the strap 12, as shown on the left in FIG. 15, by using a buckle or other adjuster 20 as shown on the right in FIG. 15, or in other ways. Any attachment scheme can be used in the FIG. 15 arrangement provided that the straps 12 can slide along the loop 21.

The pads 13 may be formed as shown in FIGS. 6–9. Alternately, the pads 13 could be fixed to the shoulder straps 12 and not allowed to slide along the straps 12. The pads 13 may include a resilient foam, a fluid-filled bladder or other element to distribute the force of the shoulder straps 12 and increase the comfort of the wearer.

The lumbar support 14 may include a pouch that is formed in the container 11 and into which a support bladder 19 or other resilient material is inserted. The support bladder 19 could be inserted into the pouch through an access 18. Alternately, the lumbar support 14 need not be formed as part of the container 11. Instead, the lumbar support 14 could be removably attached to the container 11, e.g., by hook-and-loop fastening devices. Another possibility is that the lumbar support 14 could be held in place by the shoulder straps 12 that pass through the loops 15 over the support 14 and are attached to the container 11. In addition, as mentioned above, the lumbar support 14 could include multiple components, e.g., multiple air bladders, that together extend across the rear of the backpack or otherwise form the lumbar support 14.

The shoulder strap attachment configuration shown in FIG. 13 is a preferred arrangement, but the shoulder straps 12 could be attached to the container 11 without using the guides 15. That is, the shoulder straps 12 could be attached to the container 11 at a position above the lumbar support 14, below the lumbar support 14, on the sides of the container 11, etc. The preferred strap 12 attachment configuration shown in FIG. 13 has been found, however, to provide benefits such as concentrating the weight of the carrier 1 at the wearer's lumbar area, and reducing movement of the container 11 relative to the wearer as the wearer moves, and ensuring that the lumbar support 14 maintains appropriate contact with the wearer's lumbar region.

Figure 14:
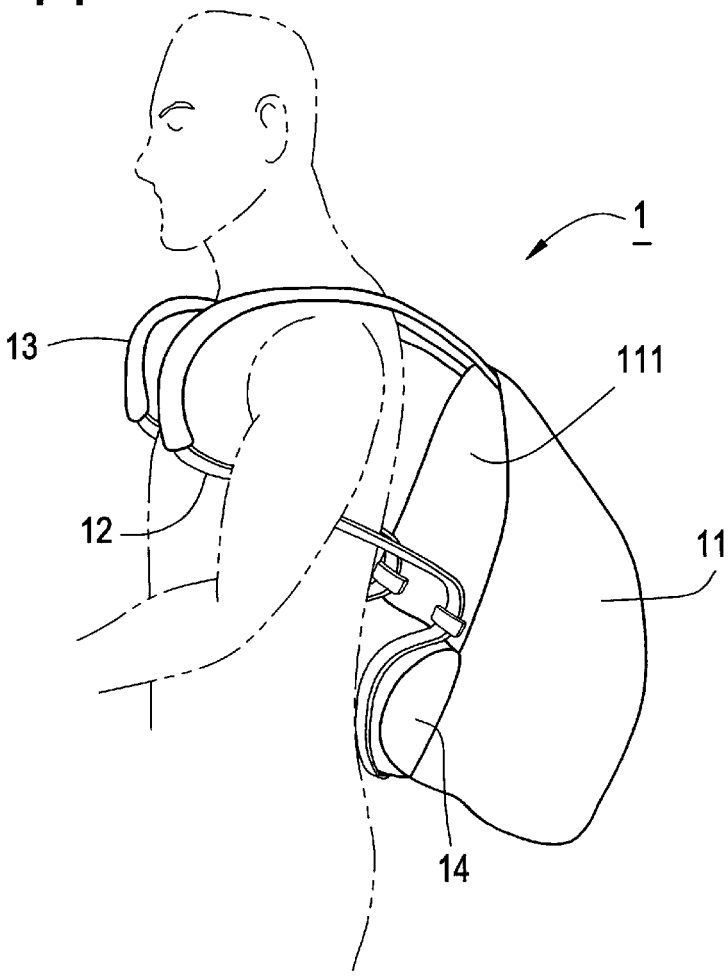
FIG. 14 is a side view of a shoulder carrier in a backpack configuration on a wearer.

As with other embodiments of the shoulder carrier 1, the shoulder straps 12 should be properly adjusted so that optimum weight distribution characteristics can be achieved. That is, as shown in FIG. 14, the shoulder straps 12 should be adjusted so that the lumbar support 14 is properly positioned at the lumbar region of the wearer's back (or at the wearer's hip in the case of single strap shoulder carriers)

and to ensure that the back portion 111 of the container 11 does not contact the wearer's back. By preventing the back portion 111 from contacting the wearer's back, weight may be properly transferred to the lumbar region rather than to the shoulders or other portions of the back. When properly adjusted, the shoulder carrier 1 can also encourage the wearer to stand and walk with improved posture. That is, the lumbar support 14 may push in on the wearer's lumbar region while the shoulder straps 12 pull back on the shoulders. Thus, the wearer may have a higher tendency to carry the shoulder carrier 1 in an upright position. This is in contrast to conventional backpacks in which all or most of the pack weight is carried by the shoulders, which results in encouraging the wearer to stoop or bend over, especially when carrying a heavy backpack. The inflation pressure of the lumbar support 14 and the shoulder pad 13 bladders 34 should also be adjusted to provide maximum comfort and weight transfer. In general, the inflation pressure should be adjusted to prevent the container 11 or the shoulder straps 12 from contacting the wearer and to create a large surface area of contact between the wearer and the lumbar support 14 and the shoulder pads 13. However, since the size and shape of shoulder areas, lumbar spine regions and hip area of different wearers can vary widely, some experimentation may be required to achieve an optimum configuration.

An added benefit of the backpack arrangement shown in FIG. 13 is that the backpack can be worn with only one shoulder strap 12 and still provide benefits of transferring weight to the lumbar region of the wearer. Thus, even when only using one strap 12 on the backpack, the lumbar support 14 can rest on the lumbar spine or hip of the wearer and transfer weight to the lumbar spine or hip. In an alternate embodiment, the backpack could have a single shoulder strap 12 that is attached to the container 11 in a way similar to that in FIG. 13, or may be attached without the use of a guide 15 or other similar element, e.g., the bottom end of the strap may be attached to the rear of the backpack above, at, or below the lumbar support 14. One difference in the single strap embodiment may be that the bottom of the strap 12 may extend from top to bottom near the midline of the backpack rather than at the lateral sides as shown in FIG. 13. That is, the top and bottom ends of the shoulder strap may be attached at centered top and bottom locations, respectively, that are spaced in equidistantly from the sides of the backpack. As a result, the wearer may wear the backpack with the single strap 12 over either shoulder in much the same way some people wear conventional two-strap backpacks over a single shoulder. The single strap backpack may also be worn with the strap over the head of the wearer, similar to that shown in FIG. 2. Positioning the single strap along the midline of the backpack, arranging the lumbar support 14 and/or other appropriate arrangement of the backpack may allow a portion of the lumbar support 14 to appropriately contact the wearer's hip or lumbar region when the single strap backpack is worn in any of the ways mentioned above.

It has also been found that the preferred backpack configuration shown in FIGS. 13 and 15 operates as a system that provides maximum benefit to the wearer, such that the weight transfer and comfort benefits are greater than when only individual features, such as an inflatable shoulder pad 13 or the lumbar support 14, are used alone. Therefore, a preferred embodiment of a backpack-type shoulder carrier 1 includes: a pair of shoulder straps 12 that are attached to the container 11 using guides 15, a loop 21 and at least one adjuster 20, as shown in FIGS. 13 and 15; a pair of shoulder pads 13 with inflatable bladders 34 having the configuration shown in FIG. 9 and positioned between the straps 12 and the wearer; and a lumbar support 14. This preferred configuration provides maximum comfort and weight transfer to the wearer's lumbar spine (or hip when one shoulder strap 12 is used and the backpack is positioned at the wearer's side), especially when the shoulder strap 12 length is properly adjusted. However, various features, such as the shoulder strap 12 attachment configuration, the lumbar support 14, the inflatable shoulder pad 13, etc., can be used individually and not in combination with other features.

Although the invention is described in connection with the embodiments above, various alterations, modifications and improvements will occur to those skilled in the art. Such alterations, modifications and improvements are intended to be within the spirit and scope of the invention. Accordingly, the foregoing description is by way of example only, and is not intended to be limiting.

What is claimed is:

1. A shoulder carrier comprising:

a container having a top, a bottom and a rear into which items to be carried can be placed;

only a single shoulder strap having a top end attached near the top of the container and a bottom end attached near the bottom of the container, the single shoulder strap extending along a midline of the container;

a shoulder pad mounted to the single shoulder strap; and a lumbar support attached to the rear of the container that bears on a wearer's hip or lumbar region to transfer weight in the container to the hip or lumbar region, the lumbar support having a fluid-filled bladder, and having a portion that projects from the rear of the container and extends across the rear of the container.

2. The carrier of claim 1, wherein the container is formed from a flexible fabric.

3. The carrier of claim 1, wherein the shoulder pad is freely slidable along the shoulder strap.

4. The carrier of claim 1, wherein the shoulder pad includes a fluid-filled bladder.

5. The carrier of claim 4, wherein the fluid-filled bladder is removable from a shoulder pad outer covering.

6. The carrier of claim 1, wherein the shoulder strap includes at least one adjuster to adjust the length of the shoulder strap.

7. The carrier of claim 1, further comprising:

a guide attached to the rear of the container; and wherein a portion of the shoulder strap passes through the guide.

8. The carrier of claim 7, wherein the guide is attached to the back portion above the lumbar support.

9. The container of claim 7, wherein the guide comprises a webbing strip.

10. The carrier of claim 7, wherein the shoulder strap passes through the guide, over the lumbar support and is attached to the container below the lumbar support.

11. The carrier of claim 1, wherein the lumbar support extends across the bottom of the container.

12. The carrier of claim 1, wherein a portion of the lumbar support has an approximately cylindrical shape.

13. A shoulder carrier comprising:

a container having a top, a bottom and a rear into which items to be carried can be placed;

only a single shoulder strap having opposite ends attached to the container;

a shoulder pad mounted to the single shoulder strap, the shoulder pad having a fluid-filled bladder; and a lumbar support attached to the rear of the container that bears on a wearer's hip or lumbar region to transfer weight in the container to the hip or lumbar region, the lumbar support having a fluid-filled bladder, and having a portion that projects from the rear of the container and extends across the bottom of the container.

14. The carrier of claim 13, wherein the container is formed from a flexible fabric.

15. The carrier of claim 13, wherein the shoulder pad is freely slidable along the shoulder strap.

16. The carrier of claim 15, wherein the fluid-filled bladder is removable from a shoulder pad outer covering.

17. The carrier of claim 13, wherein a portion of the lumbar support has an approximately cylindrical shape.

* * * * *